US006280353B1

(12) United States Patent
Brundage

(10) Patent No.: US 6,280,353 B1
(45) Date of Patent: Aug. 28, 2001

(54) TRAINING BASEBALL BAT AND METHOD

(76) Inventor: Scott A. Brundage, 5113 Copper River Ave., Las Vegas, NV (US) 89130

( * ) Notice: Subject to any disclaimer, the term of this patent is extended or adjusted under 35 U.S.C. 154(b) by 0 days.

(21) Appl. No.: 09/363,995

(22) Filed: Jul. 29, 1999

(51) Int. Cl.[7] ..... A63B 59/06
(52) U.S. Cl. ..... 473/457; 473/519
(58) Field of Search ..... 473/457, 47, 564–568, 473/519, 520, 334–339

(56) References Cited

U.S. PATENT DOCUMENTS

| | | | | |
|---|---|---|---|---|
| 1,026,990 | * | 5/1912 | Matson | 473/519 |
| 1,499,128 | * | 6/1924 | Shroyer, Jr. | 473/519 |
| 3,116,926 | * | 1/1964 | Owen et al. | 473/519 |
| 3,414,260 | | 12/1968 | Gust . | |
| 4,593,903 | | 6/1986 | Waitz . | |
| 4,759,219 | | 7/1988 | Cobb . | |
| 4,898,386 | | 2/1990 | Anderson . | |
| 5,050,877 | | 9/1991 | Wales . | |
| 5,277,421 | | 1/1994 | Rewolinski . | |
| 5,456,461 | | 10/1995 | Sullivan . | |
| 5,674,138 | | 10/1997 | Nolan . | |
| 5,741,193 | | 4/1998 | Nolan . | |

* cited by examiner

*Primary Examiner*—Mark S. Graham
(74) *Attorney, Agent, or Firm*—Robert Ryan Morishita; Raul Martinez; Anderson & Morishita

(57) ABSTRACT

A training bat has a handle portion and a barrel portion. The barrel portion has a hollow cavity formed within and has an opening for accessing the cavity. A plurality of nestable weights can be disposed in the barrel cavity in combination. A means for closing the barrel opening is used so that the weights may be fixedly secured inside the barrel cavity.

5 Claims, 6 Drawing Sheets

TRAINING BASEBALL BAT AND METHOD

FIELD OF THE INVENTION

This invention relates generally to training bats, and more particularly, to training bats employing multiple internal weights. The invention further relates to a method of using such training bats.

BACKGROUND OF THE INVENTION

The use of various training bats is well known, and many designs and configurations have heretofore been employed to increase a ball player's strength and bat speed. The increased bat speed achieves the desired result of increasing the distance a ball will travel when struck.

Among methods and devices employed to increase bat speed are "doughnut" weights, which derive their name from their doughnut shape. Doughnut weights slide over the knob end of a bat and fit snugly around the barrel portion of the bat. The ball player then swings the weighted bat to increase strength during practice and to warm up during a game. However, one drawback of the doughnut weight is that the resultant swing motion is unnatural since the weight is concentrated in one small area of the bat rather than uniformly distributed along the barrel portion of the bat. Moreover, the external location of the weight near or on the barrel prevents the ball player from hitting balls with the weighted bat. Furthermore, doughnut weights have a tendency to become jammed on the bat and can be difficult to remove. Moreover, in some instances a jammed weight can damage the bat.

Similarly, other designs employ weights either disposed on the outside of the barrel portion of the bat (Wales, U.S. Pat. No. 5,050,877) or extending axially from the knob portion of the bat (Nolan, U.S. Pat. Nos. 5,674,138 and 5,741,193). Again, the positioning of the weights in these designs produces an unnatural swing motion.

Later, internal weights were incorporated into training bat designs. For example, the design disclosed in Rewolinski, U.S. Pat. No. 5,277,421, includes a single weight disposed on a stem in the barrel portion of the bat. The stem and weight are received in an axial sleeve in the end portion of the bat. Therefore, a ball player cannot use weights in combination to enhance training, and thus, one disadvantage of the Rewolinski design is that it cannot accommodate more than one weight at a time. Rather, a player must remove the weight currently disposed in the bat before inserting a different weight, which limits the selection of total weight that can be disposed in the bat at any given time.

Therefore, it can be appreciated that there exists a continuing need for a new and improved training bat with a weighting system which permits disposing multiple weights in the bat simultaneously as training requires. These and other advantages will be provided by the training bat set forth in this patent application.

SUMMARY OF THE INVENTION

The general purpose of the present invention is to provide a new and improved training bat comprising a baseball bat having an integral handle portion and barrel portion. The barrel portion has a hollow cavity and an opening for accessing the cavity. A plurality of nestable weights can be disposed in the barrel cavity in combination, and a means is provided for closing the opening so that the weights may be fixedly secured inside the barrel cavity.

Preferably, the opening for accessing the cavity is located at the end of the barrel portion of the bat. Optimally, the weights will be substantially cylindrical or frustoconical in shape. In a preferred embodiment, the means for closing the opening comprises an end cap which can be attached to the barrel portion with threads, bayonet connectors, or other similar structure.

In accordance with one aspect of the invention, the training bat further comprises a means such as a velocimeter, accelerometer, or the like, for measuring the speed of the bat when swung. Preferably, the measuring means would include a means for displaying the speed of the bat measured by the measuring means. In one embodiment, the display means would continue to display the highest speed measured until the ball player reset the display means.

Therefore, it is an object of the present invention is to increase a ball player's strength and bat speed. Another object is to distribute the inserted weight throughout the barrel portion of the bat. A further object is to enable a ball player to dispose weights in combination inside the training bat.

Still other objects and advantages of the present invention will become readily apparent to those skilled in this art from the following detailed description. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION

Figure 1:
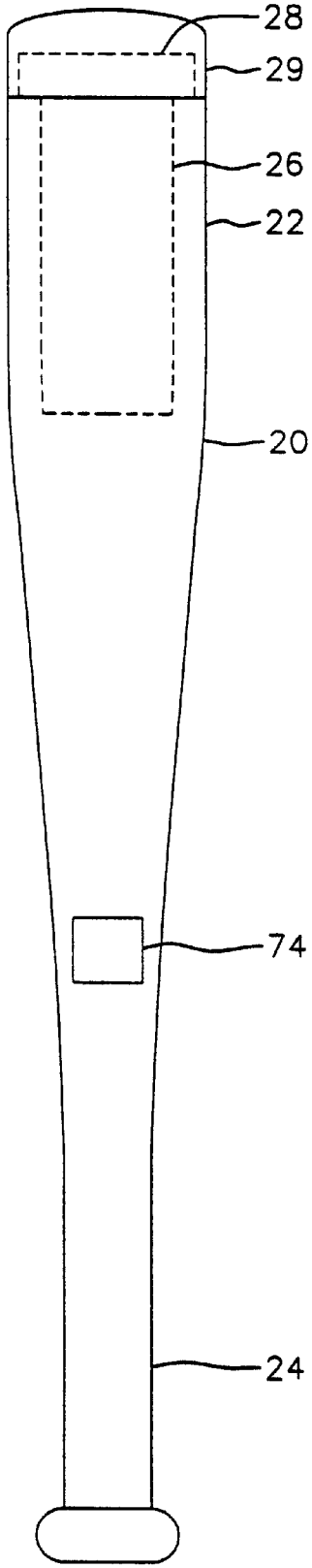
FIG. 1 is a plan view of the present invention.
Figure 1A:
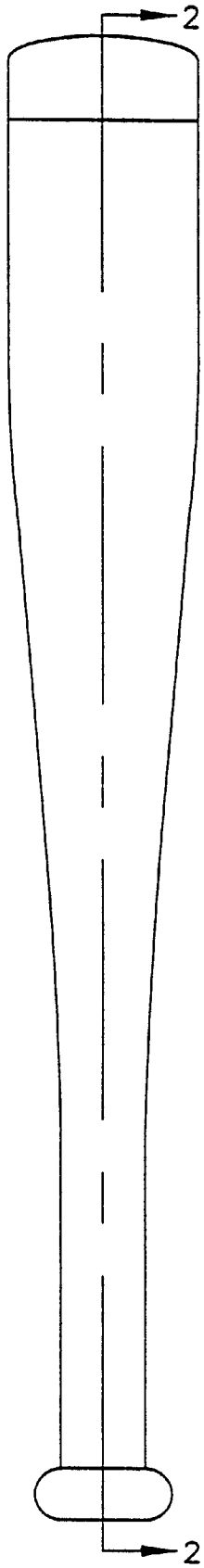
FIG. 1A is a side view of the present invention.
Figure 2:
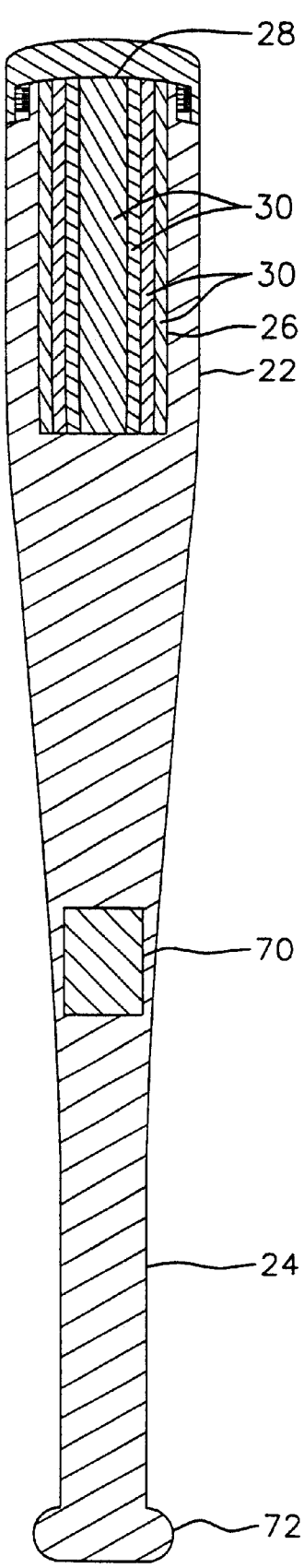
FIG. 2 is a cross-sectional view taken across line II—I in FIG. 1A.
Figure 3:
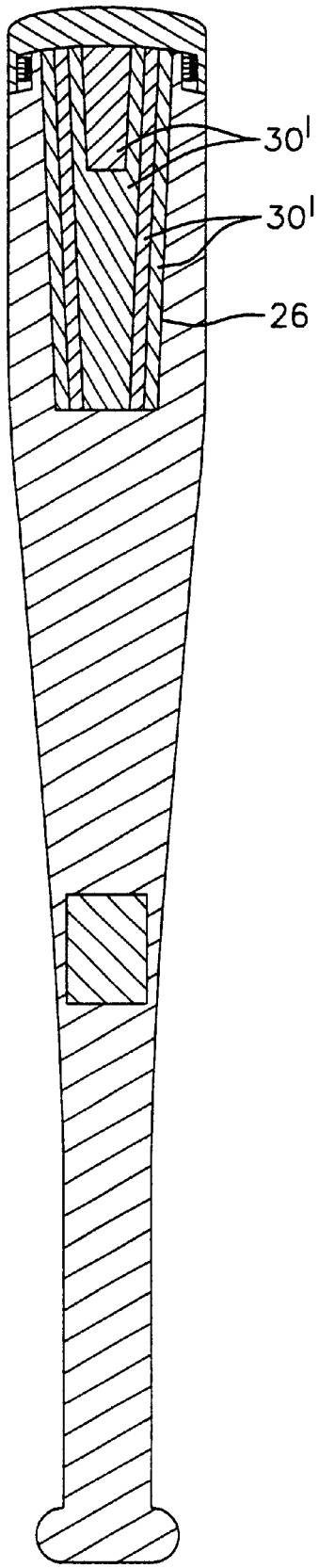
FIG. 3 is a view similar to FIG. 2, but showing an alternative embodiment of the present invention.

Turning now to the drawings, and in particular to FIG. 1, a training bat 20 comprises a barrel portion 22 and a handle portion 24. A hollow cavity 26 is formed within the barrel portion 22. The cavity 26 is accessible via an opening 28. As shown in FIG. 2, a plurality of nestable weights 30 can be disposed in combination inside the barrel cavity 26 via the opening 28. These weights 30 may be substantially cylindrical as shown in FIG. 2, or, in an alternate embodiment, the weights 30' may be substantially frustoconical as shown in FIG. 3.

Figure 4:
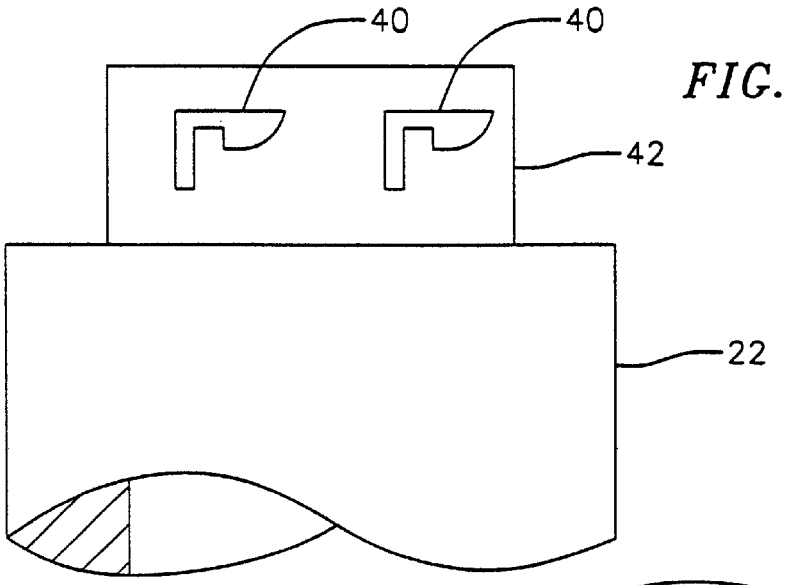
FIG. 4 is a partial view of one embodiment of the closing means used to secure the end cap to the barrel portion of the bat.
Figure 5:
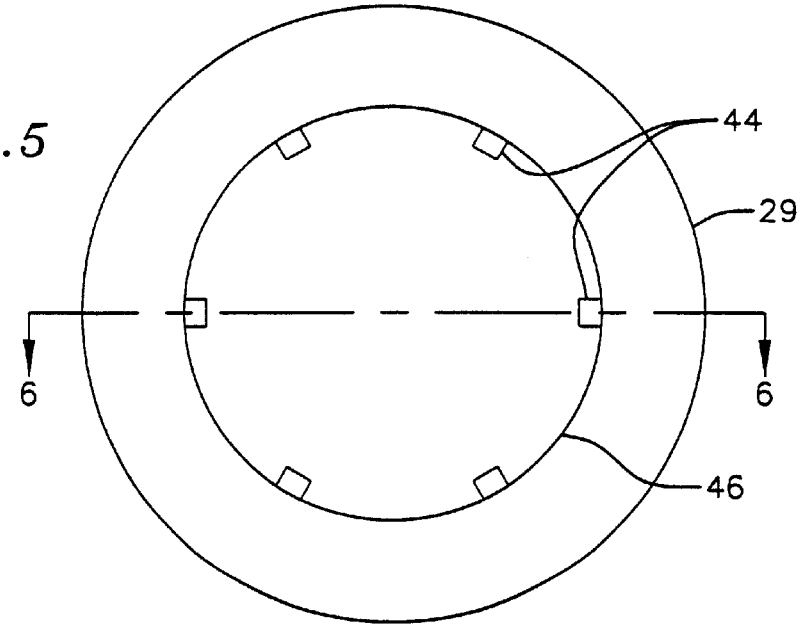
FIG. 5 is complementary to FIG. 4 and shows a bottom view of the internal structure of the end cap used in that particular embodiment.
Figure 6:
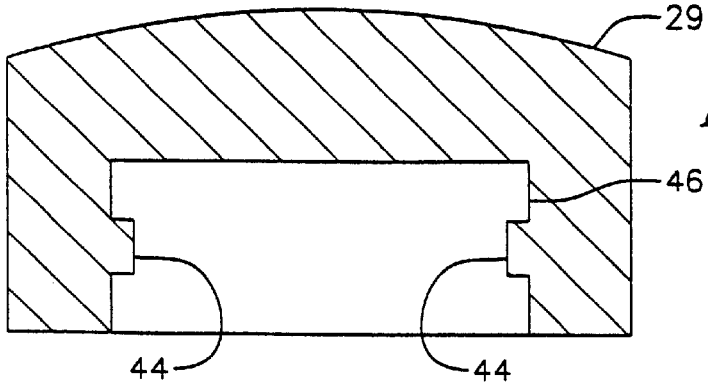
FIG. 6 is a cross-sectional view taken across line VI—VI in FIG. 5.

Returning to FIG. 1, an end cap 29 is secured to the barrel portion 22 of the bat 20 to secure the weights 30 inside the cavity 26. In the embodiment illustrated in FIGS. 4–6, bayonet connectors 40 are disposed on the outer diameter of a cylindrical protrusion 42 that extends outwardly from the barrel 22. Tabs 44 disposed on the inner diameter of an annular recess 46 formed within the end cap 29 are positioned such that they may fixedly engage complementary bayonet connectors 40 on the cylindrical protrusion 42.

Figure 8:
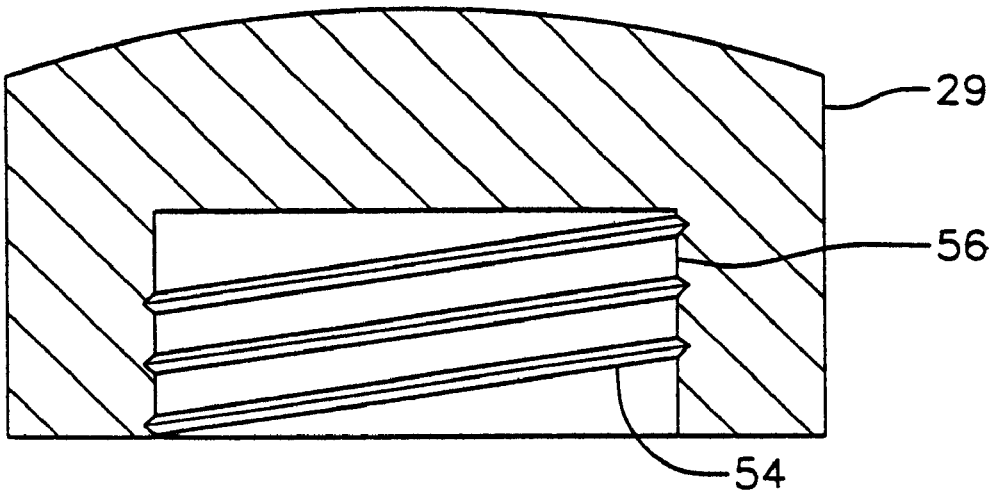
FIG. 8 is complementary to FIG. 7 and shows a cross-sectional view of the end cap used in that particular embodiment.
Figure 7:
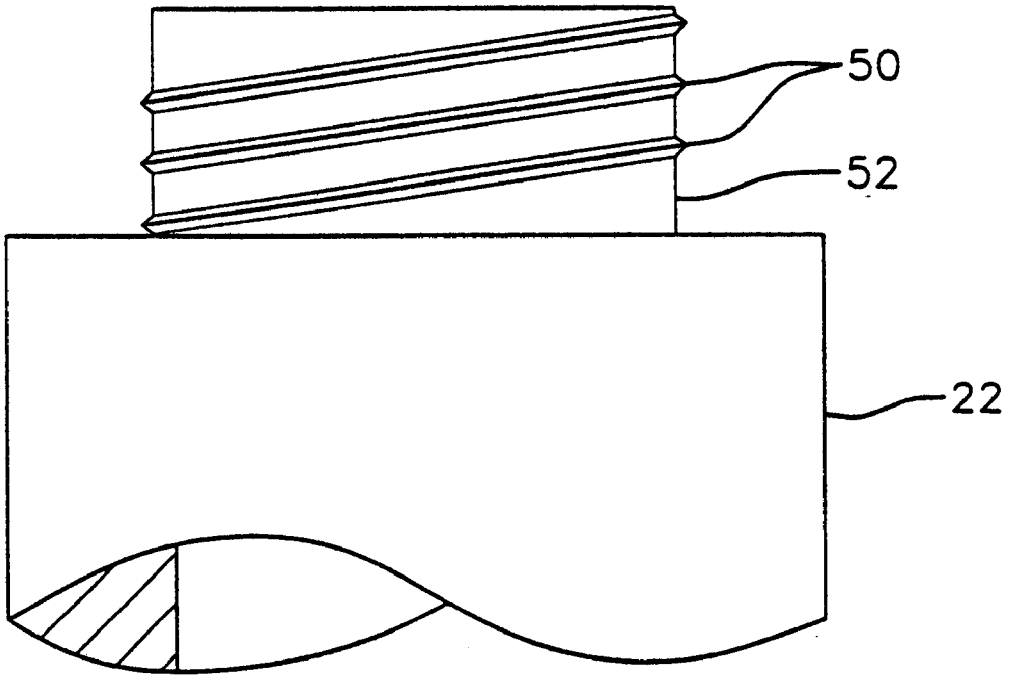
FIG. 7 is a partial view of another embodiment of the closing means used to secure the end cap to the barrel portion of the bat.

FIGS. 7–8 illustrate another embodiment in which the end cap 29 is secured to the barrel portion 22 in an alternative fashion. Namely, threads 50 are disposed on the outer surface of a cylindrical protrusion 52 that extends outwardly from the barrel 22. Threads 54 disposed on the inner surface of an annular recess 56 formed within the end cap 29 are designed to mate with the threads 50 disposed on the cylindrical protrusion 52 that extends outwardly from the barrel 22.

Figure 10:
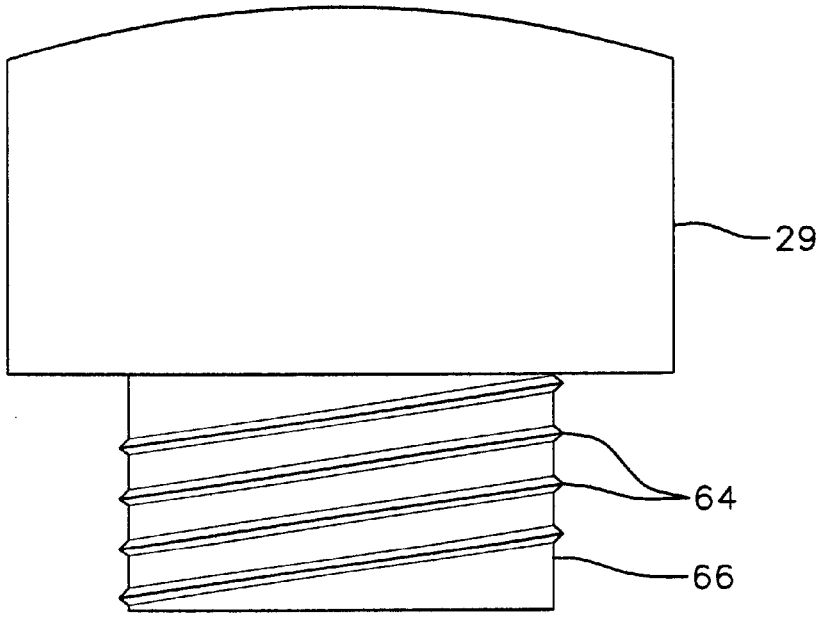
FIG. 10 is complementary to FIG. 9 and shows a side view of the end cap used in that particular embodiment.
Figure 9:
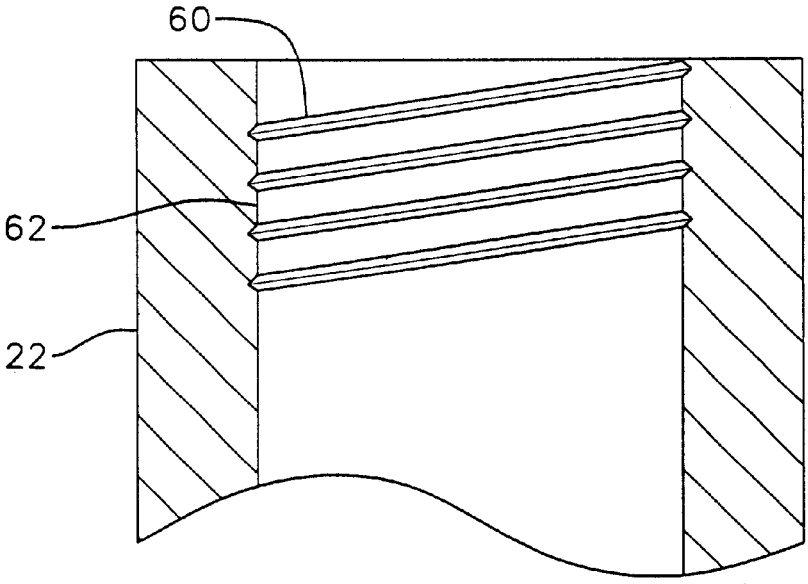
FIG. 9 is a cross-sectional view of another embodiment of the closing means used to secure the end cap to the barrel portion of the bat.

Yet another embodiment is depicted in FIGS. 9–10 in which the end cap 29 is secured to the barrel portion 22. In particular, threads 60 are disposed on the inner surface of an annular recess 62 formed within the barrel portion 22. Threads 64 disposed on the outer surface of a cylindrical protrusion 66 that extends outwardly from the end cap 29 are designed to mate with the threads 60 disposed on the annular recess 62 formed within the barrel portion 22.

Returning to FIGS. 1–2, a means for measuring bat speed 70, such as a velocimeter, accelerometer, radar, or the like, is located between the knob 72 at the end of the handle portion 24 and the barrel portion 22. The measured speed is then indicated by a display means 74 on the exterior of the bat 20. In one embodiment, the display means 74 continuously displays the highest speed measured by the measuring means 70 until the ball player resets the display means 74.

Figure 11:
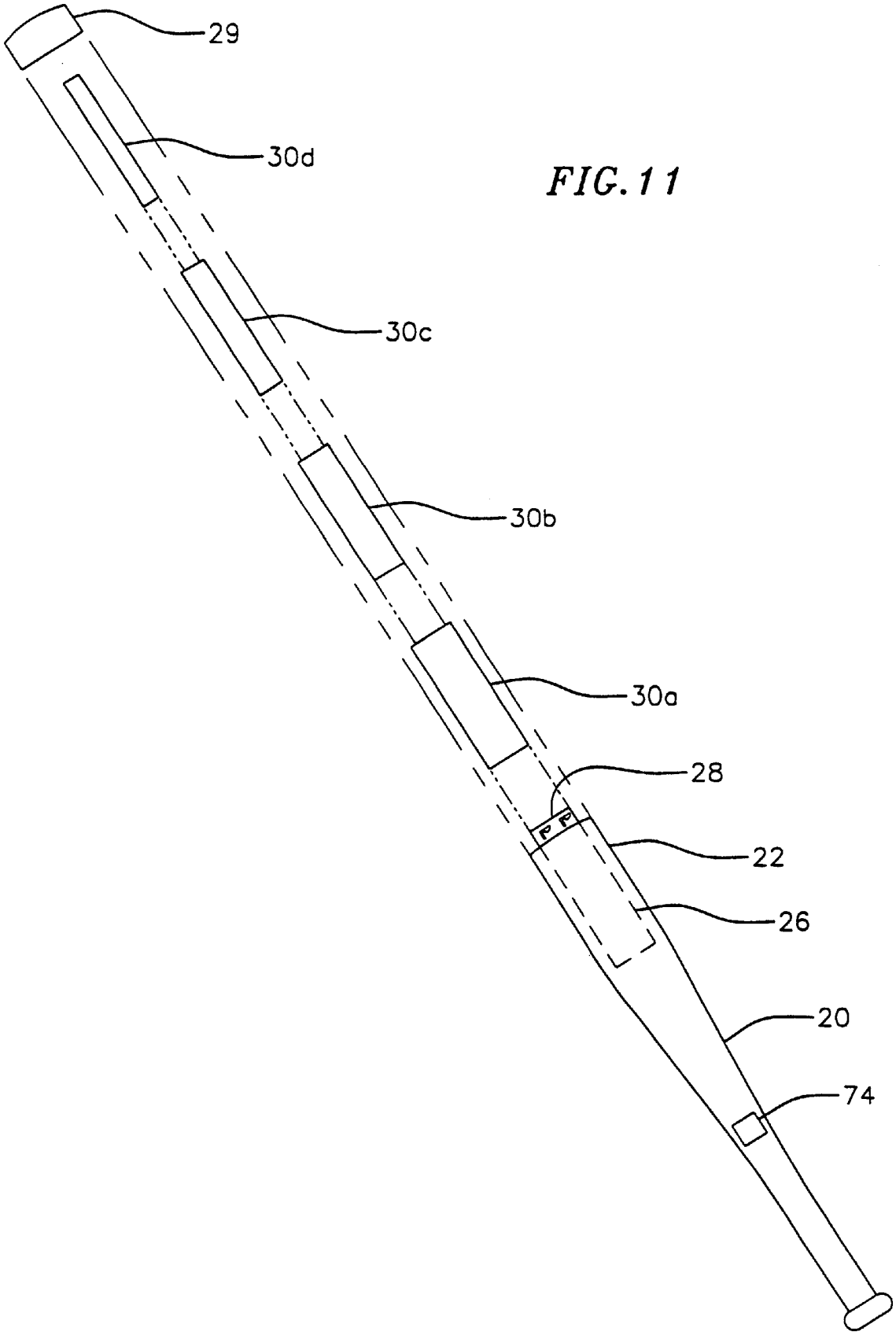
FIG. 11 is an assembly view of the present invention.

FIG. 11 illustrates how the weights 30 nest inside the bat 20. While any number of nestable weights 30 could be used, in a preferred embodiment, four weights 30*a–d* are provided. Preferably, the first weight 30*a* is substantially the same length as the cavity 26 to prevent the first weight 30*a* from moving within the cavity 26 when the bat 20 is swung. Furthermore, the second weight 30*b* is substantially the same length as the hollow portion of the first weight 30*a*. Similarly, the third weight 30*c* is approximately the same length as the hollow portion of the second weight 30*b*. Finally, the fourth weight 30*d* is substantially the same length as the hollow portion of the third weight 30*c*.

The first weight 30*a* is hollow and shaped to nest within the cavity 26. The second weight 30*b* is also hollow and nests within the first weight 30*a*. The third weight 30*c* is hollow and nests within the second weight 30*b*. The final weight, which is the fourth weight 30*d* in this embodiment, is solid and nests within the previous weight, which is the third weight 30*c* in this embodiment. The end cap 29 can be secured to close the opening 28 and thereby fixedly secure the weights 30 inside the cavity 26 or removed to allow access to the cavity 26 as required by the ball player.

Still referring to FIG. 11, a ball player wishing to increase their bat speed with the training bat 20 would initially insert the first weight 30*a* into the cavity 26 via the opening 28. The ball player would then secure the end cap 29 to the barrel portion 22, effectively securing the first weight 30*a* inside the cavity 26. Subsequently, the ball player would swing the training bat 20 a predetermined number of times (a "set"), remove the end cap 29, and nest the second weight 30*b* inside the first weight 30*a*. Again, the ball player would secure the end cap 29 to the barrel 22 and swing the bat 20 a predetermined number of times. Similarly, the ball player would remove the end cap 29, nest the third weight 30*c* inside the second weight 30*b*, secure the end cap 29 to the barrel 22, and swing the bat 20 a predetermined number of times. Finally, the ball player would remove the end cap 29, nest the fourth weight 30*d* inside the third weight 30*c*, secure the end cap 29 to the barrel 22, and swing the bat 20 a predetermined number of times. If the ball player desires, the process may further include reversing the steps; that is, removing the weights 30 in a serial fashion in between sets. The display means 74 is used throughout the training regimen to objectively determine whether the ball player's bat speed is increasing.

The design set forth in this application lends itself to a flexible training program whereby a ball player may use weights 30 in combination. Specifically, while the weights 30 could be of any weight, in a preferred embodiment for children, four seven-ounce weights are used in conjunction with a nine ounce bat. Thus, the young ball player would have the option of training at five different levels ranging from nine ounces to thirty-seven ounces. Similarly, another embodiment for adults utilizes four ten-ounce weights together with a nine ounce bat. Thus, the ball player would have the option of training at five different levels ranging from nine ounces to forty-nine ounces.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be considered to fall within the scope of the invention.

I claim:

1. A training bat comprising:

a baseball bat having an integral handle and barrel portion, said barrel having a hollow cavity formed therein and an opening for accessing said cavity;

a removable end cap for lockably closing said opening, the end cap cooperating with the hollow cavity to define the length of the barrel cavity when the end cap is secured to the bat;

a first weight having a length substantially equal to the length of said barrel cavity with a chamber therein, said first weight shaped to removably nest within said barrel cavity;

a second weight having a length substantially equal to the length of the chamber of said first weight shaped to removably nest within the chamber of said first weight; and a means for measuring the speed of the bat when swung.

2. The training bat of claim 1 wherein said first weight is substantially frustoconical in shape.

3. The training bat of claim 2 wherein the second weight is substantially cylindrical in shape.

4. A training bat comprising:

a baseball bat having a handle and barrel portion, said barrel having a hollow cavity of fixed length formed therein and an opening for accessing said cavity; and a plurality of removable nestable weights which can be selectively disposed in said barrel cavity in combination, one of said weights having a chamber therein, and another of said weights shaped to nest within the chamber, wherein at least one of said weights has a length equal to the length of said barrel cavity.

5. A training bat comprising:

a baseball bat having an integral handle and barrel portion, said barrel having a hollow cavity formed therein and an opening for accessing said cavity;

a removable end cap for lockably closing said opening, the end cap cooperating with said cavity to define the length of the barrel cavity when the end cap is secured to the bat;

a frustoconical first weight of a length substantially equal to the length of the barrel cavity having a cylindrical chamber therein, said first weight shaped to removably nest within said barrel cavity;

a cylindrical second weight of a length substantially equal to the length of the first weight chamber shaped to removably nest within the cylindrical chamber of said first weight; and a means for measuring the speed of the bat when swung.

* * * * *